US006752268B1

(12) United States Patent
Wadsworth

(10) Patent No.: US 6,752,268 B1
(45) Date of Patent: Jun. 22, 2004

(54) BIT STORAGE HOLDER

(76) Inventor: Jake Wadsworth, 20 Dublin Gulch Rd., St. Ignatius, MT (US) 59865

( * ) Notice: Subject to any disclaimer, the term of this patent is extended or adjusted under 35 U.S.C. 154(b) by 0 days.

(21) Appl. No.: 10/189,999

(22) Filed: Jul. 2, 2002

Related U.S. Application Data

(63) Continuation of application No. 29/159,591, filed on Apr. 23, 2002.

(51) Int. Cl.[7] ..... B65D 85/20
(52) U.S. Cl. ..... 206/379; 408/239 R; 408/241 R
(58) Field of Search ..... 206/368, 369, 206/379; 408/239 A, 239 R, 241 R

(56) References Cited

U.S. PATENT DOCUMENTS

| | | | | | |
|---|---|---|---|---|---|
| 2,842,260 | A | * | 7/1958 | Molitor | 206/379 |
| 4,604,005 | A | | 8/1986 | Russ | |
| 4,850,758 | A | * | 7/1989 | Morgan | 408/239 A |
| 4,973,205 | A | | 11/1990 | Spaulding | |
| 5,526,721 | A | | 6/1996 | Waisvisz | |
| 5,586,847 | A | * | 12/1996 | Mattern, Jr. et al. | 408/239 A |
| 5,651,647 | A | * | 7/1997 | Ray | 408/239 A |
| 5,810,525 | A | | 9/1998 | Ector, Sr. | |
| 5,881,615 | A | | 3/1999 | Dahl et al. | |
| 5,957,634 | A | * | 9/1999 | Carpinetti | 408/239 A |
| 6,076,440 | A | | 6/2000 | Hsu | |
| 6,302,409 | B1 | * | 10/2001 | Gutsche | 408/239 A |
| 6,347,914 | B1 | * | 2/2002 | Boyle et al. | 408/239 A |
| 2001/0032531 | A1 | | 10/2001 | Kozak et al. | |

* cited by examiner

*Primary Examiner*—Jim Foster
(74) *Attorney, Agent, or Firm*—Saliwanchik, Lloyd Saliwanchik

(57) ABSTRACT

A drill bit holder which mounts directly on a drill makes drill bits readily accessible to a user. A connector shaft is at one end of the holder for insertion into any type of drill. A casing provides storage for bits that are not in use. Preferably, the casing rotates independently of the shaft providing a user a stabilizing grip for the drill. A bit receiving housing is at the other end of the holder having a bit receiving channel to engage the drill bits. The bit receiving housing can be configured to specifically receive locking bits, non-locking bits or configured to universally receive locking and non-locking bits.

5 Claims, 3 Drawing Sheets

BIT STORAGE HOLDER

REFERENCE TO RELATED APPLICATIONS

The subject application is a continuation of design patent application Ser. No. 29/159,591, filed Apr. 23, 2002. The disclosures of this application is hereby incorporated by reference in its entirety, including all figures, tables, and drawings.

BACKGROUND OF THE INVENTION

A power drill has become an indispensable tool. Screwdriver bits used on power drills have nearly replaced the use of conventional screwdrivers. Cordless drills offer the maneuverability of the hand-held tool with the consistency and power of a power tool. This all-in-one tool is not convenient however unless all the bits and fittings required for a project are readily available. U.S. Pat. No. 5,810,525 describes a rubber sleeve to go around the handle of a drill that can be used to store spare drill bits. Several drills with mechanized bit feeding systems have been described that make bits readily available (U.S. Pat. Nos. 4,604,005 and 4,973,205). Hand-held tools have been described that store bits in their handles (U.S. Pat. Nos. 5,526,721, 5,881,615, 6,076,440, and U.S. Patent Application Publication US/2001/0032531 A1). These available bit storage options however often interfere with the handling of the tool or complicate the mechanism of the drill. Others, are configured for hand-tools only and do not offer the power and consistency of a cordless drill. Thus, there remains a need for a simple, convenient storage system for drill bits that makes the bits readily accessible to the drill user.

All patents, patent applications, provisional patent applications and publications referred to or cited herein, or from which a claim for benefit of priority has been made, are incorporated by reference in their entirety to the extent they are not inconsistent with the explicit teachings of the specification.

SUMMARY OF THE INVENTION

The subject invention involves a drill bit holder that is designed for use on a power drill. The holder, at one end, has a connector shaft for insertion into the chuck of a drill. At the other end, a bit receiving channel can operably receive, both locking and non-locking bits. A bit storage casing stores and holds bits which are currently not in use. The bit storage holder of the subject invention operably engages a power drill. Thus, any bit that may be needed during the course of a job is readily available to the user.

In a preferred embodiment of the bit holder of the subject invention the connector shaft and bit receiving channel are integral with and along a central shank. The subject configuration is particularly strong. Further, the bit storage casing is designed to rotate independently of the shank which advantageously provides a grip for a user to stabilize the drill while it is in use as well as allows for convenient selection of drill bits from the casing while the holder is mounted on the drill.

DETAILED DESCRIPTION OF THE INVENTION

The invention relates to a drill bit holder that can be mounted on a drill. At one end of the holder is a connector shaft which is received by the drill. At the other end of the holder a bit receiving channel and housing receive locking or non-locking bits. Between the connector shaft and the bit receiving housing, a casing securely stores bits that are not being used.

Figure 1:
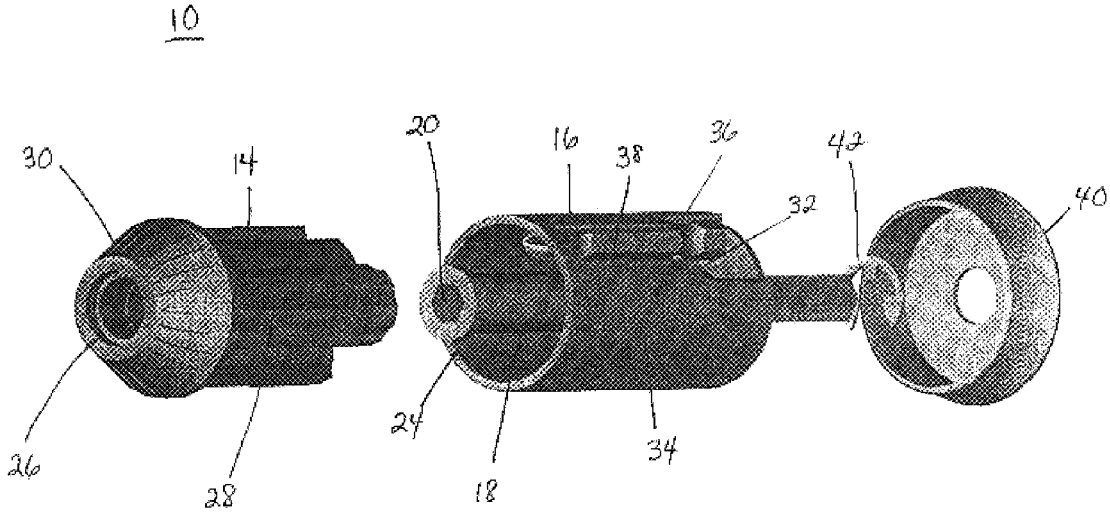
FIG. 1 shows an exploded perspective view of a preferred embodiment of the bit storage holder of the subject invention.
Figure 2:
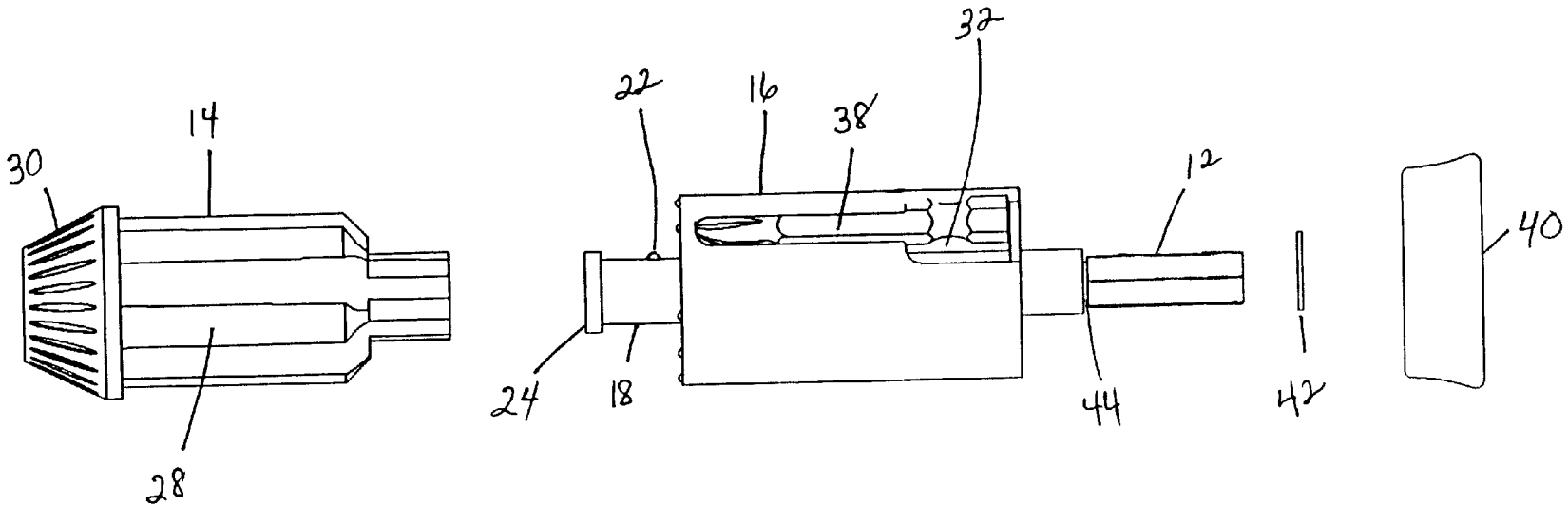
FIG. 2 shows an exploded side plan view of a preferred embodiment of the bit storage holder of the subject invention.
Figure 3:
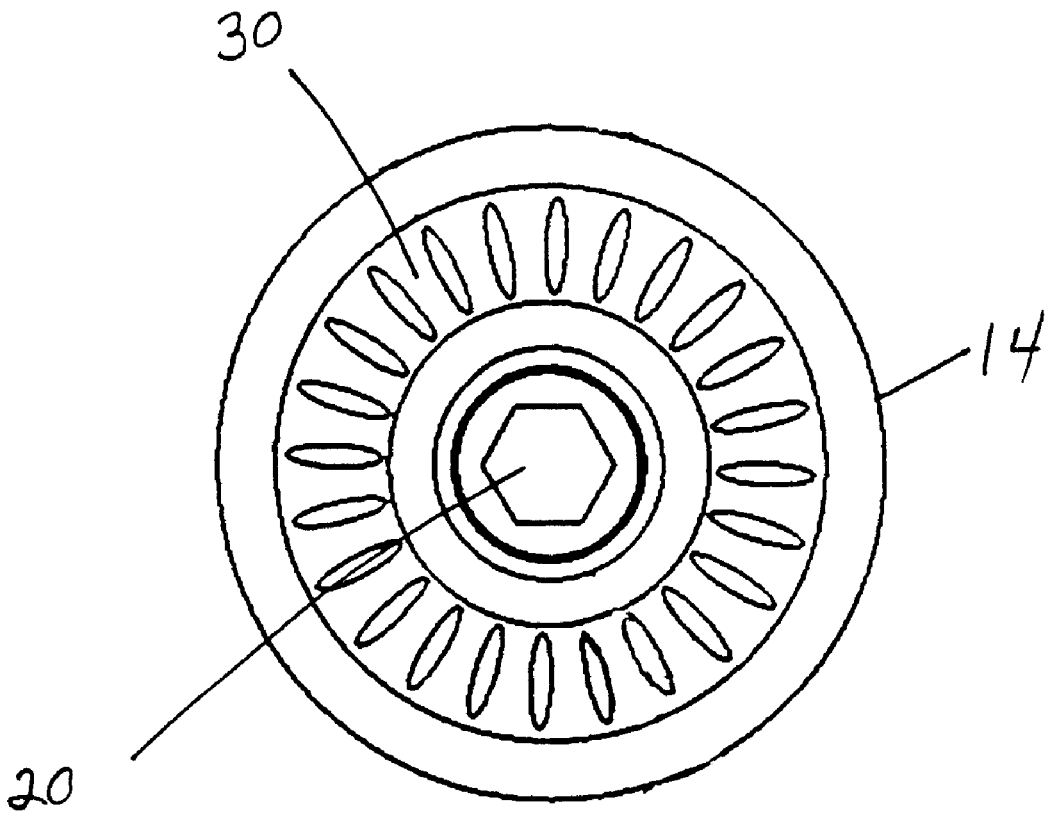
FIG. 3 shows an plan view of the bit receiving end of a preferred embodiment of the bit storage holder of the subject invention.

A preferred embodiment of the bit holder of the subject invention is shown generally at 10 in FIG. 1. The holder comprises a centralized shank 18. One end of the shank 18 is a connector shaft 12 adapted to fit into the chuck of a drill. The connector shaft 12 can be either unitarily defined in the shank 18 or separately formed and structurally interconnected with the shank. In either instance the connector shaft is in axial alignment with the shank. In the exemplified embodiment, the connector shaft is hexagonal in cross-section adapted to fit into a keyless chuck or collet lock system on the drill. The connector shaft 12 can likewise be configured to fit a magnetic chuck or a ball-locking, power bit, system. Specifically, for a power bit system, the connector shaft 12 is hexagonal in cross-section. The outer end of the shaft is beveled to aid insertion of the shaft into the receiving channel of the drill chuck. An annular groove defined in the periphery of the shaft, which is somewhat elliptical to allow ease of motion for fastening and releasing, is spaced inward from the outer end of the shaft and engages the fastening element of the chuck as the shaft is slid into the receiving channel of the drill chuck. Locking bit systems are known in the art and have been fully described in various patents, such as U.S. Pat. No. 6,261,035 B1, which is hereby incorporated by reference.

A bit receiving channel 20 lies at the other end of the shank 18. In the exemplified embodiment, the bit receiving channel 20 is hexagonal in cross-section and configured to receive a locking, power bit. Specifically, the channel is fitted with a spring-biased ball 22 which engages the annular groove of a locking, power bit.

A lip 24 on the end of shank 18 captures bit receiving housing 14. In this embodiment, the bit receiving housing 14 has a shoulder 26, longitudinal grooves 28, and is tapered at the outer end 30. This configuration of the housing is aesthetically pleasing and conforms to the conventional appearance of a drill chuck. The longitudinal grooves 28 further aid grip. The configuration of the exemplified housing 14 should however not be considered limiting. The bit holder of the subject invention can be configured to aid in the function of both receiving and locking the bits. For example, in a keyless chuck or collet type locking system (U.S. Pat. No. 5,938,212) the housing might provide a fastening function to capture the bit in the channel 20. Further, one skilled in the art is aware of changes that must be made to the bit receiving channel 20 and/or bit receiving housing to accommodate various locking and non-locking bit systems which include, but are not limited to, magnetic bits.

A bit storage casing 16 holds bits that are not being used so that they are convenient and available for the user. In the exemplified embodiment, the casing 16 is generally cylindrical in shape. Bits are stored in a plurality of separate, outwardly extending grooves 32 that extend generally along the longitudinal axis of the casing. The grooves 32 can include knobs or catches to secure the bits in the grooves. Further, the grooves can be shaped to provide finger access for a user to remove the bit from the groove, see for example U.S. 2001/0032531 A1. In the exemplified embodiment, the bit storage casing 16 has a sleeve 34 to retain the stored bits in the grooves 32. The sleeve 34, has a slot 36 through which the drill bit to be used is removed. The sleeve is rotated until the slot 36 is over the desired bit, the bit is then removed for insertion into the bit receiving housing and channel 20. In a particularly preferred embodiment, the sleeve 34 is transparent to assist a user in locating the desired bit.

The bit storage casing 16 can be structurally distinct from the shank 18 as exemplified or structurally interconnected with the shank 18. When the casing is structurally distinct from the shank 18, as shown, the casing rotates independently of the drill-driven shank. Thus, the casing 16 can be held by the user to steady the drill during operation. Further, when the casing can rotate independently, a user wishing to change a bit can simply rotate the casing on the drill, identify and remove the desired bit, place the old bit into the casing for storage and mount the new bit in the bit receiving channel without having to remove the holder from the drill.

To assemble the drill bit holder shown in the exemplified embodiment of the subject invention, the bit receiving housing 14 is slid over the connector shaft end of the shank 18. The lip 24 of the shank 18 catches a shoulder 26 of the bit receiving housing 14. The bit storage casing 16 is slid onto the shank 12 behind housing 14. A spring cap 40 is slipped onto the shank 12 and secured by a lock ring 42 which engages an annular groove 44 in the shank 18 at the base of connector shaft 12. One skilled in the art would realize that the bit receiving housing 14, the bit storage casing 16 and the spring cap 40 could each be structurally interconnected with the shank 18 by, for example, welding or providing interlocking threads and corresponding structures. The structure shown provides the additional advantages of strength in the integral shank, and ease of manufacture with its easily assembled parts.

In use, a user mounts the connector shaft 12 of the drill bit holder 10 into the chuck of a drill. The user then chooses a stored drill bit 38 from the storage casing and inserts the desired bit into the bit receiving channel 20. The drill and bit are then ready for use.

It is understood that the foregoing examples are merely illustrative of the present invention. Certain modifications of the articles and/or methods employed may be made and still achieve the objectives of the invention. Such modifications are contemplated as within the scope of the claimed invention.

What is claimed is:

1. A drill bit holder comprising a central shaft including a connector shaft which is hexagonal in cross-section for insertion into a drill chuck at one end, and a bit receiving channel to operably receive a drill bit at another end, a bit storage casing to store at least one spare drill bit surrounding the central shaft, wherein said at least one spare drill bit is stored outside the central shaft.

2. The drill bit holder of claim 1, wherein said connector shaft comprises an annular groove for engagement with a locking member of said drill chuck.

3. A drill bit holder comprising a central shaft including a connector shaft for insertion into a drill chuck at one end, and a bit receiving channel which is hexagonal in cross-section to operably receive a drill bit at another end, a bit storage casing to store at least one spare drill bit surrounding the central shaft, wherein said at least one spare drill bit is stored outside the central shaft.

4. The drill bit holder of claim 3, wherein said bit receiving channel further comprises a spring-biased ball to lockably engage said drill bit.

5. A drill bit holder comprising a central shaft including a connector shaft for insertion into a drill chuck at one end, and a bit receiving channel to operable receive a drill bit at another end, a bit storage casing to store at least one spare drill bit surrounding the central shaft and a spring cap abutting said bit storage casing proximate said connector shaft, wherein said at least one spare drill bit is stored outside the central shaft.

* * * * *